US010640917B2

(12) United States Patent
Pan et al.

(10) Patent No.: US 10,640,917 B2
(45) Date of Patent: May 5, 2020

(54) FABRIC PRETREATMENT FOR DIGITAL PRINTING

(71) Applicant: Lubrizol Advanced Materials, Inc., Cleveland, OH (US)

(72) Inventors: Yun-Long Pan, Cincinnati, OH (US); Gary A. Anderle, North Olmsted, OH (US); Stacy L. Rohde, North Olmsted, OH (US)

(73) Assignee: LUBRIZOL ADVANCED MATERIALS, INC., Cleveland, OH (US)

( * ) Notice: Subject to any disclaimer, the term of this patent is extended or adjusted under 35 U.S.C. 154(b) by 167 days.

(21) Appl. No.: 15/105,045

(22) PCT Filed: Nov. 20, 2014

(86) PCT No.: PCT/US2014/066564

§ 371 (c)(1),
(2) Date: Jun. 16, 2016

(87) PCT Pub. No.: WO2015/094564

PCT Pub. Date: Jun. 25, 2015

(65) Prior Publication Data

US 2016/0312404 A1 Oct. 27, 2016

Related U.S. Application Data

(60) Provisional application No. 61/917,446, filed on Dec. 18, 2013.

(51) Int. Cl.
*D06P 1/52* (2006.01)
*D06P 5/30* (2006.01)
(Continued)

(52) U.S. Cl.
CPC ..... *D06P 1/5278* (2013.01); *D06P 1/5242* (2013.01); *D06P 1/5264* (2013.01);
(Continued)

(58) Field of Classification Search
CPC .... C08L 79/00; D06P 1/52; D06P 5/22; D06P 5/30; B41M 5/00
See application file for complete search history.

(56) References Cited

U.S. PATENT DOCUMENTS 3,912,693 A * 10/1975 Shimizu ..... C08F 26/02 522/14
4,341,887 A * 7/1982 Buriks ..... B01D 17/047 210/749
(Continued)

FOREIGN PATENT DOCUMENTS

EP 0947350 A1 10/1999
EP 1240383 B1 9/2002
(Continued)

*Primary Examiner* — Vasudevan S Jagannathan
*Assistant Examiner* — Preeti Kumar
(74) *Attorney, Agent, or Firm* — Teresan W. Gilbert; Vincent A. Cortese

(57) ABSTRACT

An aqueous blend of an azetidinium functionalized polymer and a polymer having quaternary amine groups is disclosed for use as aqueous pretreatment for substrates such as textiles and garments that are going to be digitally printed. The pretreatment may further comprise wetting agents, surfactants, and preservatives. The pretreatment may be dry or wet immediately prior to digital printing and may be heat treated to bond the pretreatment to the substrate and/or the subsequent print ink.

20 Claims, 2 Drawing Sheets

(51) Int. Cl.
*D06P 5/22* (2006.01)
*B41M 5/00* (2006.01)

(52) U.S. Cl.
CPC ..... *D06P 1/5285* (2013.01); *D06P 5/22* (2013.01); *D06P 5/30* (2013.01); *B41M 5/0011* (2013.01)

(56) References Cited

U.S. PATENT DOCUMENTS

| | | | | |
|---|---|---|---|---|
| 4,689,418 | A * | 8/1987 | Buriks | B01D 17/047 548/952 |
| 4,954,395 | A | 9/1990 | Hasegawa et al. | |
| 6,291,023 | B1 | 9/2001 | Nigam et al. | |
| 7,429,558 | B2 | 9/2008 | Batchelor et al. | |
| 2004/0263598 | A1 | 12/2004 | Watanbe et al. | |
| 2007/0103528 | A1 | 5/2007 | Pearl et al. | |
| 2008/0024536 | A1 | 1/2008 | Hirano et al. | |
| 2008/0092309 | A1 | 4/2008 | Ellis et al. | |
| 2009/0191383 | A1 | 7/2009 | Kluge et al. | |

FOREIGN PATENT DOCUMENTS

| | | | | |
|---|---|---|---|---|
| EP | 1356155 | B1 | 10/2003 | |
| EP | 1924658 | B1 | 5/2008 | |
| EP | 2388371 | B1 | 8/2015 | |
| WO | 92/07124 | A1 | 4/1992 | |
| WO | 98/29530 | A2 | 7/1998 | |
| WO | 99/54144 | A1 | 10/1999 | |
| WO | WO 9954144 | A1 * | 10/1999 | B41M 5/52 |

* cited by examiner

FABRIC PRETREATMENT FOR DIGITAL PRINTING

CROSS REFERENCE TO RELATED APPLICATION

This application claims priority from PCT Application Serial No. PCT/US2014/066564 filed on Nov. 20, 2014, which claims the benefit of U.S. Provisional Application No. 61/917,446 filed on Dec. 18, 2013.

FIELD OF INVENTION

The invention relates to a substrate pretreatment for digital printing derived from a bonding polymer having reactive azetidinium (AZE) groups, a water soluble cationic amine polymer, appropriate wetting agents, and optionally coagulating acidic additives. Such pretreatments are useful in various ink receptive applications, including digital and/or textile printing.

BACKGROUND OF THE INVENTION

Digital printing, including inkjet, is a method of reproducing an image or data onto a medium directly from a computer, typically on conventional substrates. When the ink is applied onto the media, it should stay in a tight, symmetrical dot; otherwise the dots of the ink will begin to penetrate into the receiving media, feather, or spread out in an irregular fashion to cover a slightly larger area than the digital printer designer intended (dot gains). The result is an image or data that appears to have low color intensity, fuzziness, especially at the edges of objects and text, etc. (color bleeding or color to color bleeding).

EP 1 924 658 to E.I. Du Pont de Nemours describes an aqueous vehicle (ink) having dispersed therein titanium dioxide pigment dispersed with a polymeric dispersant and a crosslinked polyurethane binder additive (different from the polymeric dispersant). The white ink was deemed especially useful for printing images on non-white textiles.

US 2008/0092309 A1 to E.I. Du Pont de Nemours describe an aqueous inkjet printing pretreatment comprising a nonionic latex polymer and a multivalent cationic salt.

US 2007/0103528 to Kornit relates to an ink for digitally printing to produce high-quality and durable abrasion-fast image which will not deteriorate in washes or be harsh to the touch and brittle.

EP 1 356 155 to Kimberly-Clark Worldwide, Inc. relates to a cationic polymer coating formulation for ink jet printing used in conjunction with imbibing solutions. The imbibing solutions can be urea (for acid dye-based ink) or ammonium salts such as ammonium oxalate and ammonium tartrate. In one embodiment, the formulation includes 5-95% cationic polymers or copolymers and from about 5-20% fabric softeners. The cationic polymers are shown in FIGS. 1A-1C of the reference and appear to be free radically polymerized polymers such as from diallyl ammonium monomers.

EP 1 240 383 to Kimberly Clark Worldwide, Inc. relates to coating formulation improvements including imbibing solutions for treating substrates such as cationic polymers or copolymers and fabric softeners. It also describes polymeric latex binders' ability to increase washfastness.

U.S. Pat. No. 6,291,023 teaches a coating agent comprising an agent selected from one of a) azetidinium polymer, b) guanidine polymer, c) a mixture of azetidinium polymer and a guanidine polymer, and d) a copolymer of azetidinium monomer and a guanidine monomer. The coating is used on textiles to provide high quality printed images when printed with reactive dye.

WO92/07124 discloses a treatment for fibres using polymers carrying imidazoline and azetidinium groups. WO98/29530 discloses laundry detergent compositions with polyamide-polyamines to provide appearance benefits. Epichlorohydrin reaction products with adipic acid-diethylenetriamine are disclosed in the abstract. U.S. Pat. No. 7,429,558 discloses azetidinium modified polymers and fabric treatment therefrom, that avoids stain fixing and dye adsorption.

U.S. Pat. No. 4,954,395 discloses a recording medium comprising an ink-transporting layer and ink-retaining layer. EP 0 947 350 discloses an ink jet recording material optionally comprising a cationic resin. US 2004/0263598 discloses a method for textile printing that includes a pre-treating that may include a fixing agent such as Danfix™ 723. US 2009/0191383 discloses a method of coloring textile substrates and a pretreatment bath. US2008/0024536 discloses an image forming apparatus and method along with cationic organic compounds.

The above references teach different ways to improve properties of images on various backgrounds. Some call for cationic polymers, some call for fabric softeners, some call for crosslinked particles, some recite titanium dioxide pigments while others use reactive dyes. They all seem to seek soft-feel images on textiles that have good color intensity, crisp well defined images, and good retention of color during mechanical washing of the textiles.

SUMMARY OF THE INVENTION

The present invention is directed towards substrate pretreatment compositions comprising an azetidinium functionalized polymer, a partially or fully quaternized copolymer of sulfur dioxide and allylamine and/or diallylamine, a surface tension modifier, and an optional preservative (if the pretreatment is going to be stored for an extended period of time). The pretreatment can also include optional polymeric binders, particulate material, and other additives to help it perform better and maintain its appearance and color after being digitally printed on. The pretreatment helps digitally printed images achieve high color intensity, good fabric hand, wash durability, image durability, etc.

The pretreatment is particularly useful for light or white colored textiles having cotton and/or polyester fibers. Light and white colored textiles often have a variety of pretreatments already applied to provide permanent press, wrinkle resistance, stain resistance, and desirable hand texture. These various pretreatments can change the contact angle of digital inks on the fabric fibers (causing the ink to over-penetrate or under-penetrate the textile) and can interfere with permanent adhesion of the digital ink by preventing direct and binding contact of the digital ink to the fabric fibers. It would be desirable to have a universal white pretreatment that promoted high color intensity digitally printed pigmented images on textiles that subsequently resisted color loss during normal laundry processes. High color intensity is normally achieved by minimizing penetration of the ink into the fabric and retaining most of the ink on the surface of the fabric. Resisting color loss is normally achieved by providing good binding between the fiber and ink such that during aqueous laundry operations the ink is not washed free of the fibers. This may involve crosslinking of the ink to the fiber or crosslinking of the ink to prevent swelling and softening of the ink during aqueous laundry steps.

BRIEF DESCRIPTION OF THE DRAWING

The attached drawing illustrates the Chromaticity Diagram from ASTM E308-85 color results on a digitally printed image on top of either a commercial direct to garment pretreatment or the Example A pretreatment of this disclosure.

DETAILED DESCRIPTION OF THE INVENTION

Figure 1:
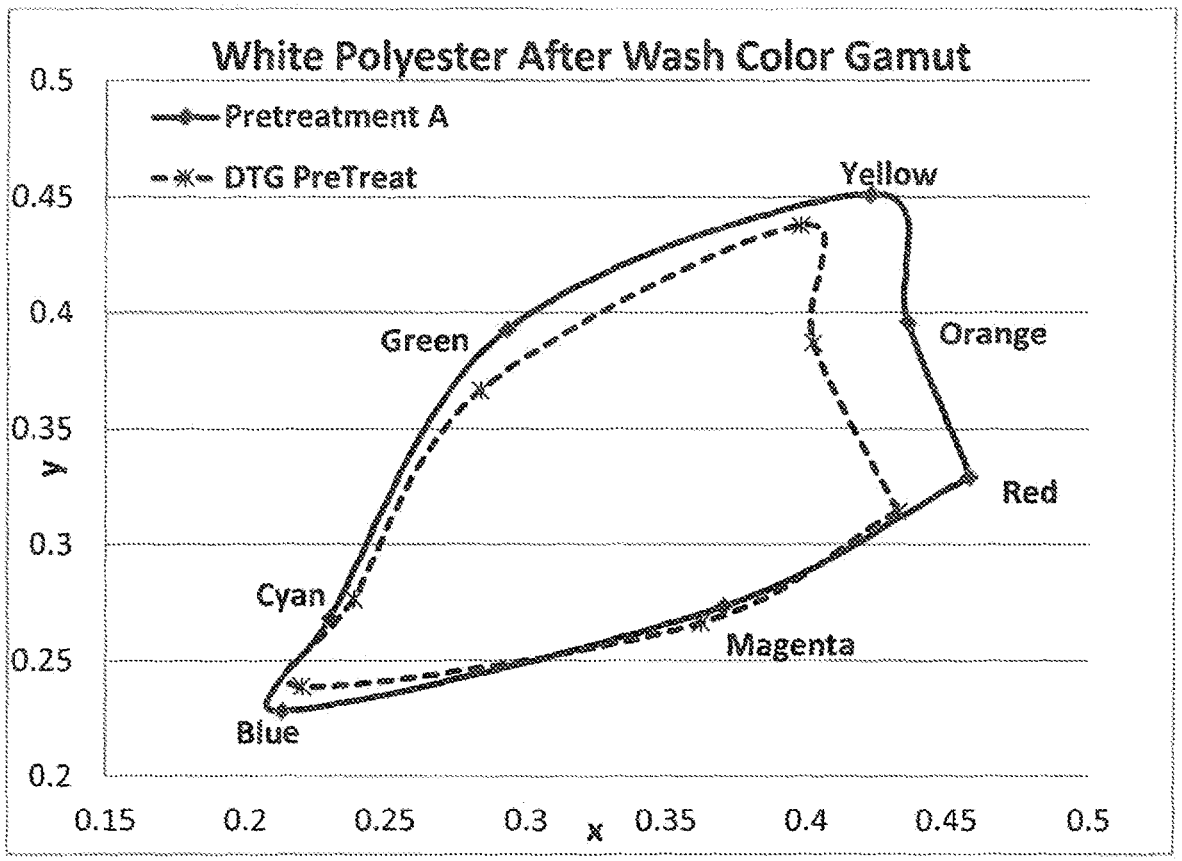

The azetidinium functionalized polymer is well known to the wet strength enhancement of paper and to permanent press type functions to other clothing. Azetidinium functionalized polymers are known to be chemically reactive and form bonds to amine, carboxyl, hydroxyl, and thiol functionality on other materials such as substrates. While not wishing to be bound by theory, it is theorized that the azetidinium functionalized polymers bind both to the cotton fibers and to the binder in later applied inks, enhancing binder and color retention during laundry procedures on the printed image on the treated substrate. Preferred azetidinium functionalized polymers are formed by reacting epichlorohydrin with polymers containing secondary amine groups or with secondary amine groups on monomers that are subsequently polymerized or copolymerized with other ethylenically unsaturated monomers to form copolymers. Two preferred classes of azetidinium functionalized polymers include the reaction products of polyamides reacted with epichlorohydrin (known as PAE resins) and polyamines reacted with epichlorohydrin (known as PAmE resins).

An "azetidinium functionalized polymer" is a polymer comprised of monomeric subunits containing a substituted or non-substituted azetedine ring (i.e., a four membered nitrogen-containing heterocycle). In general, the azetidinium polymers useful herein are composed of monomer units having the structural formula (I):

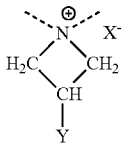

where X is usually chlorine and Y is usually OH along with optional other repeat units from other monomers. The dashed bond lines going to the polymer are going to alkylene groups, $X^-$ is an anionic, organic or inorganic counterion, and Y is selected from the group consisting of hydrogen, hydroxyl, halo, alkoxy, $C_1$-$C_6$ alkyl, amino, carboxy, acetoxy, cyano and sulfhydryl. Each of the methylene groups may independently also be substituted with a group selected from hydroxyl, halo, alkoxy, alkyl, amino, carboxy, acetoxy, cyano, $C_1$-$C_6$ alkyl, and sulfhydryl. Preferred polymers are where $X^-$ is selected from the group consisting of halide, acetate, methane sulfonate, succinate, citrate, malonate, fumarate, oxalate and hydrogen sulfate, the methylene groups of the structure are independently non-substituted or substituted with a $C_1$-$C_6$ alkyl, and Y is hydrogen or hydroxyl.

The azetidinium polymer may be a homopolymer, or it may be a copolymer, wherein one or more non-azetidinium monomer units are incorporated into the polymer structure. Any number of co-monomers may be employed to form suitable azetidinium copolymers for use herein; however, a particularly preferred azetidinium copolymer is aminoamide azetidinium. Further, the azetidinium polymer may be essentially straight-chain or it may be branched or crosslinked. The amount of the azetidinium polymer is desirably from about 0.1 to about 50 wt. % as weight of active polymer per weight of the pretreatment, more desirably from about 0.2 to about 10, 20 or 30 wt. %.

The percentage of reactive azetidinium groups in the polymer can be adjusted in a controlled manner to tailor the number of reactive groups in the polymer. Azetidinium groups are insensitive to pH change; however, such groups are highly sensitive to the presence of anionic and nucleophilic species. In some cases, it may be desirable to adjust the reaction conditions used to prepare the azetidinium polymer (e.g., by raising the pH) to generate anionic groups within the polymer, which then participate in intra-molecular crosslinking. At other times (such as when the polymer will be stored for weeks or months) it is desirable to keep the pH below 5, 4, or 3 to stabilize the polymer against intra-molecular crosslinking.

Desirably, these azetidinium functionalized polymers have at least 5, 10, or 15 azetidinium groups per polymer. There is an upper limit on the number of azetidinium groups because the polymer backbone can only have a limited number of secondary amine groups and the number of secondary amine groups limits the number of azetidinium groups on the polymer. The polymers of the functionalized polymers generally have a number molecular weight from about 5,000 to about 175,000 g/mole prior to functionalization with azetidinium groups. Within the industry they refer to low molecular weight polymers having molecular weights from 5,000 to 12,000 and higher molecular weight polymers having molecular weights from 125,000 to 175,000 g/mole. After functionalization with azetidinium groups the polymers can intra-molecularly crosslink and further increase their molecular weight.

Such polymers are commercially available and include "AMRES™," available from Georgia Pacific Resins, Inc., Atlanta, Ga., "KYMENE™," from Hercules, Inc., Wilmington, Del., and "Polycup™," from Hercules, Inc. and/or Ashland Chemical. These azetidinium polymers are generally referred to as poly(aminoamide)-epichlorohydrin (PAE) resins; such resins are typically prepared by alkylating a water-soluble polyamide containing secondary amino groups with epichlorohydrin. Other suitable azetidinium polymers will be known to those skilled in the art and/or are described in the pertinent texts, patent documents, and literature references.

One example of making azetidinium functionalized polymers is U.S. Pat. No. 5,510,004 which details making azetidinium functionalized polymers for N,N-diallyl-3-hydroxyazetidinium and optional other co-monomers (PAmE, polyamine epichlorohydrin). Preferred co-monomers are acrylamide, diallylamine, diallylamine hydrohalides, methyldiallylamine, methyldiallylamine hydrohalides, dimethyldiallylammonium halides, maleic acid, sodium vinylsulfonate, sodium acrylate, sodium methacrylate, N,N-dimethylaminoethylmethacrylate, dimethylaminoethylacrylate, sodium salt of 2-acrylamido-2-methyl-1-propanesulfonic acid, N-vinyl-2-pyrrolidinone, N-vinylformamide, N-vinylacetamide, vinyl acetate, 2-vinylpyridine, 4-vinylpyridine, 4-styrenesulfonic acid, hydroxyethyl methacrylate, hydroxypropyl methacrylate, hydroxyethyl acrylate, hydroxypropyl acrylate, glycidyl acrylate and glycidyl methacrylate. The most preferred co-monomer is N-vinyl-2-pyrrolidinone. The preferred level of unsaturated co-monomer present in the copolymers in the reference is expressed as a mole fraction of N,N-diallyl-3-hydroxy azetidinium halide plus unsaturated co-monomer is from about 10 to about 85 mole percent, more preferably about 30 to about 65 mole percent and most preferably about 45 to about 55 mole percent. For the case of copolymers of N,N-diallyl-3-hydroxy azetidinium chloride and N-vinyl-2-pyrrolidinone, the preferred mole ratio is about 50% N,N-diallyl-3-hydroxy azetidinium chloride and about 50% N-vinyl-2-pyrrolidinone.

Another article on azetidinium functionalized polymer (PAE, polyamide epichlorohydrin) is Characterization of Polyamideamine-Epichlorohydrin (PAE) Resins, Roles of Azetidinium Groups and Molar Mass on PAE in Wet Strength Development of Paper Prepared with PAE; Takao Obakata et al., J. of Applied Polymer Science, Vol. 97, Issue 6, Jun. 28, 2005, pp. 2249-2255. In that article, they describe how to make a PAE resin by reacting methyl adipate and diethylene triamine at a 1:1 molar ratio at 130-140° C. for 5 hours to create a polyamide with a secondary amine group from the diethylene triamine. They cool the polymer to about 30° C. and add drop wise epichlorohydrin (at a 1.1:1 mole ratio of epichlorohydrin to the secondary amine group) for 30 minutes, dilute to 20 mass % with water, and then allow the reaction to continue for 4.5 hours. They then heated the mixture to 60° C. to convert the 3-chloro-2-hydroxypropyl group to azetidinium while keeping the pH below 3 to minimize crosslinking.

A second component to the pretreatment solution is a cationic polymer. The cationic polymer helps to coagulate the binder and pigment in later applied digital inks to prevent the digitally applied inks from migrating from their desired location. It is believed that migration of yellow pigmented ink through the polyester textile is partially controlled through the use of the cationic polymer. The cationic polymer may also function as a reactive site to crosslink the azetidinium groups of the azetidinium functionalized polymer. Coagulating the ink binder and the pigment is believed to enhance color intensity (especially on polyester fibers). The cationic polymer of this invention is believed to provide better wash resistance (stability of color intensity after aqueous laundry operations) than cationic metal salts which are widely used in the pretreatment for dark garment. The cationic metal salts tend not to work well directly with colored inks probably due to their water solubility and the interference with dye anchoring. The cationic polymer of this invention also potentially crosslinks with the azetidinium functional polymer and is bound to the fibers and the ink binder.

A preferred cationic polymer is copolymers of sulfur dioxide and diallylamine and/or allylamine co-monomer(s). By diallylamine we mean to include mono and dialkyl ($C_1$-$C_6$) substituted diallylamine and in particular quaternized amine versions of these monomers. By allylamine we mean mono, di, and trialkyl ($C_1$-$C_6$) substituted allylamine and in particular quaternized versions of said allylamine. By diallylamine we mean mono and dialkyl (C1-C6) substituted diallylyamine and in particular quaternized versions of said diallylyamine. We prefer copolymers with at least 5 wt. % of repeat units of the formula $—S(=O)_2^-$, and up to 40 wt. % of those repeat units. More preferred are copolymers with from 10 to 35 wt. % repeat units of the formula $—S(=O)_2^-$. The other about 60 to about 95 wt. % (or 65 to 90 wt. %) of the copolymers can be allylamine or diallylyamine repeat units or blends of those repeat units with other amine containing monomers or monomers that don't contain amine groups. Desirably, the copolymers contain from at least 5, 10, 15, 20, 30, or 40 wt. % of repeat units derived from free radically polymerizing allylamine or diallylamine (or combinations of allylamine and diallylyamine if both are present). Polymer weight average molecular weights are desirably from about 3,000 to 200,000 g/mole. A preferred copolymer is CAS 26470-16-6, a copolymer of dimethyldiallylammonium chloride with sulfur dioxide of about 4000 or 5000 g/mole molecular weight. It is believed that CAS 26470-16-6 corresponds to Danfix™ 303 available from Nittobo Medical Co. Ltd., Kudan first place, 4-1-28 Kudan-Kita, Chiyoda-Ku, Tokyo, Japan 102-8489. It is believed that diallylamine copolymers with sulfur dioxide are lower in yellow color than copolymers of diallylamine without sulfur dioxide. Normally, during quaternization not all tertiary amines are quaternized. For our use, the quaternized amines are more effective, but not all of the amine groups need to be tertiary and/or quaternized to achieve the effect. Desirably the copolymer of sulfur dioxide and allylamine and/or diallylamine is used in an amount from 0.1 wt. % to about 50 wt. % as weight of active polymer per weight of the pretreatment, more desirably from about 0.2 to about 10, 20 or 30 wt. %.

If the digital ink has a moderate to low surface tension, it may be desirable to add a small amount of a coagulating acid to prevent bleed through of black ink and other colored inks from the desired top textile surface to the bottom of the textile surface. Desirably, these coagulating acids are water soluble (desirably water soluble at concentrations of 10 g/l or more, more desirably 25 g/l or more, and preferably 50 g/l or more at 25° C.) acid component selected from organic acids such as carboxylic acid or combinations thereof. These water soluble acids will be called coagulation acids as their function is to help coagulate colloidally stabilized inks applied over the pretreatment. The coagulating acid, can have one or more carboxylic acid groups. It generally has from 1 to 20 carbon atoms, and more preferably from 1 to 10 carbon atoms. Preferred organic coagulating acids include formic, acetic, adipic, citric, tartaric, itaconic, maleic, and/or oxalic acids. Preferred organic acids include itaconic acid and/or polyitaconic acid. When the coagulating acid is used, desirably it is used in an amount from about 0.2 to about 15 weight percent, more desirably about 0.4 to about 6, 8, or 10 weight percent based on 100 parts by weight of the pretreatment. Such acids have little effect on polyester but may degrade cotton or cellulose based fibers (especially at high acid concentrations or at elevated temperatures).

Most of the residual of the pretreatment is water which can be present from about 50 weight percent to about 80, 90, 97.6, 98, or 99 weight percent of the pretreatment. The pretreatment could be prepared at higher concentrations and shipped to users, but is generally more effective when diluted down to about 1-10 weight percent active ingredients and the residual being aqueous carriers and specialty additives before applying to a textile substrate. Thus, the pretreatment is characterized more as a fiber treatment (implying modifying the surface of the fiber to facilitate appropriate surface interaction and binding to ink) rather than a coating that might separate the fiber from the later applied ink. It is noted that while in the later experiments the pretreatment was dried before the ink was applied, the pretreatment might still be wet when the first ink is applied to the substrate. More refined methods of pretreatment application would also facilitate higher ingredient concentrations, which would shorten drying times (as less water would be applied).

The pretreatment composition is preferably provided in an aqueous liquid vehicle, although small amounts of a water-soluble polar organic solvent may be present to adjust the surface tension, promote better fiber wetting and help to control foam. The aqueous liquid vehicle will generally be water, although other nonorganic compounds that are either water soluble or water miscible may be included as well. Representative polar solvents include monohydric and polyhydric alcohols such as ethanol, isopropyl alcohol, benzyl alcohol; mono and polyalkylene glycols of less than 200 g/mole molecular weight such as diethylene glycol, propylene glycol, and the like; and mono and poly(alkyleneglycol) ethers of less than 200 g/mole molecular weight such as ethylene glycol monomethyl ether, diethylene glycol monoethyl ether, dipropylene glycol monobutyl ether (DPnB), ethylene glycol monobutyl ether acetate (EBA), diethylene glycol monobutyl ether (DB), ethylene glycol monobutyl ether (EB), dipropylene glycol monomethyl ether (DPM), and diethylene glycol monomethyl ether (DM). Monohydric alcohols when present are desirably present from about 0.2 to about 10 weight percent and more desirably from about 0.3 to about 5 weight percent. Mono and polyalkylene glycols, when present, are desirably present from about 0.02 to about 4 weight percent and more desirably from about 0.04 to about 1 weight percent of the pretreatment.

Preservatives, bactericides, and fungicides may also be present in the formulation to prevent the growth of biological species that might discolor, colloidally destabilize, pH shift or otherwise damage the pretreatment compositions. These would be present in appropriate amounts known to those skilled in the art of preserving dilute aqueous treatment solution.

In another embodiment, the pretreatment composition comprises a mixture of an azetidinium functionalized polymer and a copolymer of sulfur dioxide and allylamine and/or diallylamine. The two polymers may be present in any suitable ratio relative to one another. The relative amounts of copolymer to azetidinium functionalized polymer can range from about 0.05 wt % copolymer/99.95% azetidinium functionalized to 0.05% azetidinium functionalized polymer/99.95% copolymer. The actual relative amounts of copolymer and azetidinium functionalized polymer will vary according to the composition of the ink to be used (e.g., the nature of the colorant in the ink), the nature of the textile substrate, and other factors affecting the use of the polymers, such as the relative market price for each polymer. In general, it is sometime preferable to about equal amounts of copolymer relative to azetidinium functionalized polymer (20 wt. %:80 to 80:20 or 40:60 to 60:40).

In this embodiment, it is desirable that the pH of the pretreatment composition while in aqueous media be acidic, as the composition tends to gel at basic pH. If necessary, then, an acid should be added to the pretreatment composition to ensure that the pH is below 7.0, preferably less than about 5.5, and most preferably in the range of about 1.0 or 2.0 to 5.5. Once the pretreatment has dried the pH is no longer important with respect to gel prevention. Some of the organic acids evaporate during drying to facilitate gel formation.

Although it will be appreciated that any of a number of azetidinium functionalized polymers and copolymers of sulfur dioxide and allylamine and/or diallylamine can be used to prepare the pretreatment compositions and coated textile substrates described herein, a preferred polymer is a poly (aminoamide)-azetidinium polymer, e.g., a polyazetidinium chloride-based polymer, such as a polyamide-polyamine-epichlorohydrin resin.

The pretreatment composition of the invention doesn't require an additional film-forming binder or resin. The addition of such a binder can help color washfastness in some cases, but it also tends to alter color of the fabric (leaving a shadow background). By "film-forming binder" is meant a substance that provides for improved strength of a textile substrate upon application of the substance to the substrate. If the pretreatment is meant for a polymeric film substrate, a polymeric binder of compatible nature to the substrate may be desirable.

Additional pretreatment composition components may include, but are not necessarily limited to, inorganic fillers, anti-curl agents, or additional conventional components such as a surfactant, plasticizer, humectant, UV absorber, light fastness enhancer, polymeric dispersant, dye mordant, optical brightener, fabric softener or leveling agent, as are commonly known in the art. Additional components that may be desirable for use in the textile pretreatment compositions of the invention will be known to those skilled in the art and/or described in the pertinent texts and literature.

Textile Substrates

In general, the textile pretreatment compositions and printing methods of the invention can be used with any textile substrate amenable to use with such pretreatment compositions and methods. Suitable textile substrates for use with the present invention include textiles having natural, synthetic, cellulose-based, or non-cellulose-based fibers or any combination thereof. Exemplary textile substrates include, but are not limited to, textiles having hydroxy group-containing fibers such as natural or regenerated cellulosic fibers (cotton, rayon, and the like); nitrogen group-containing fibers such as poly(acrylonitrile); natural or synthetic polyamides (including wool, silk, or nylon); and/or fibers having acid-modified polyester and polyamide groups. Textiles are normally associated with the use of yarns or strings comprised of multiple or complex fibers. Textiles, as used herein, includes carpeting, rugs, window treatments, etc. that use yarn containing materials to create desirable appearances or surface features. The substrates may be additionally pre-treated or after-treated with resins or other substances compatible with the pretreatment compositions and methods of the invention, and may be finished or unfinished. The textile substrate may also be formed into garments and sized prior to application of the present pretreatment compositions. Alternatively, the present pretreatment compositions may be incorporated into an external sizing process, so that sizing and pretreatment is conducted in a single step. As the pretreatment works well with cellulose and cotton based fibers it would help color intensity and color retention on a variety of paper products, cardstocks, and cardboards.

The fibers of the textile substrate may be in any suitable form compatible with the selected printing process. e.g., loose yarns, or fabrics. Fabrics are a convenient and preferred form. The fibers may be blended with other fibers that are susceptible to treatment with a pretreatment composition of the invention, or with fibers that may prove less susceptible to such treatment. The process may also be used with polyester films with appropriate adjustments. Additional exemplary substrates for use in the invention include polyester films such as "MYLAR" flexible film, polysulfones, cellulose triacetates, and the like. Coated transparent films are also contemplated.

The pretreatment described herein possesses advantageous features as a universal pretreatment for white and light colored textiles and fabrics. For example, the textile substrate pretreated with the pretreatment described herein does not discolor or yellow. Additionally, the pretreatment composition is compatible with a variety of textiles. Moreover, textile substrates coated with the pretreatment compositions described herein result in consistent vibrant colors when digitally printed and resist color fading during aqueous laundry operations better than the pretreatments available on the market.

The invention also features a printed, treated textile substrate produced using the methods and pretreatments compositions described herein. The treated textile substrates of the invention can be printed using any suitable printing method, e.g., conventional methods of printing, digital printing, particularly inkjet printing, including drop on-demand printing and continuous jet printing, and the like. In one embodiment of particular interest, the treated textile substrates are printed by an inkjet printing method. In general, the printing process involves applying an aqueous recording liquid to a treated textile substrate in an image pattern Ink jet printing processes are well known in the art. In addition, images printed on treated textile substrates according to the present invention are also detergent resistant and/or detergent-fast.

Preferred Digital Inks

Inks useful in combination with the inventive fabric pretreatments comprise colorants typically used in field of inkjet printing. Pigmented colorants are especially useful since the resulting printed images are light stable, deliver high coloration and are durable to extended wash cycles. Pigment particles used in the inks are desirably small in particle size and narrow in particle size distribution so that they jet well from the small nozzles used in inkjet printheads. The pigment particles are desirably reduced in particle size by means known in the art, typically by milling operations, to a mean particle size less than about 200 nm and more desirably less than 100 nm. Pigment particles useful in the present invention are stabilized by means of a dispersant or self-dispersing by means known in the art of inkjet printing. Preferably, the stabilizing groups on the pigment particle or dispersant are anionic in nature although some nonionic stabilizers can be used. Anionic groups interact strongly with the inventive pretreatment compositions to limit the penetration of the ink particles through the treated fabric thereby delivering vibrant and washfast colors to the target fabric.

Pigmented inks preferably contain binders that contribute to the washfastness and durability of the printed images when used in combination with the inventive fabric pretreatments. Desirable binders include those used in the art of textile printing such as, for example, vinyl acetate, acrylic, polyester and polyurethane binders. It is preferable that the polymeric binders are flexible and tough so that the resulting printed image can survive physical abrasion and stretching encountered in common use of the fabrics. It is desirable that the ink binder has a minimum film elongation to break greater than about 100% and more preferably greater than 400%. Useful binders preferably have tensile strengths greater than about 20 $N/mm^2$. If the ink binder is in a particulate form in the ink composition, it is desirable that the average size of the binder particles is small and the distribution is narrow. Binder particles having mean sizes below about 100 nm and more preferably below about 50 nm are desirable. Pigmented inks useful in the present invention also contain surfactants to aid in jetting of the pigment particles from the print-head and for interaction with the pretreated fabric. Any of the well-known surfactants in the art of inkjet printing can be contemplated for use and are preferably anionic or nonionic in nature Inks containing anionically stabilized pigment particles are commercially available from many suppliers and are exemplified by the Dupont Artistri™ inks.

Individual pigmented ink compositions were prepared using cyan, magenta, yellow and carbon black pigment dispersions as the pigment sources. The pigment dispersions were stabilized by means of anionically charged polymeric dispersant and mean particle sizes of the pigment particles were in the range of 50 to 160 nm. Aqueous pigmented ink components were combined according the following formulation ranges, with the balance totaling to 100% using deionized water.

Active Component Ranges Used in Aqueous Pigmented Inks

| | |
|---|---|
| Anionically dispersed Pigment | 3.5-4.5 wt. % |
| Polyurethane Binder | 3-7% |
| Glycol Humectants | 8-15% |
| Surfactants | 0.1-0.5% |
| Biocide | 100 ppm |
| Water | Balance to 100% |

The resulting inks were printed from a DTG Digital Viper by Colman and Company onto the treated fabrics.

The detergent to which the images are resistant includes a variety of commercially available detergents, (e.g., anionic detergents, cationic detergents, nonionic detergents, amphoteric detergents, etc.). Anionic detergents to which the printed, treated textile substrates are resistant include, but are not necessarily limited to, alkyl aryl sulfonates (e.g., linear alkyl benzene sulfonate), alkyl aryl condensates (e.g., DDB (dodecyl benzene)), long chain (fatty) alcohol sulfates (e.g., having a chain of 12 to 18 carbon atoms), olefin sulfates and sulfonates, alpha olefin sulfate and sulfonates, sulfate monoglycerides, sulphate ethers, sulfosuccinates, alkane sulfonates, phosphate esters, alkyl isothionates, and sucrose esters.

Fabric and garment pretreatments generally desired as low color white or clear coatings so they can be applied over a wide variety of different colored substrates. The pretreatment and digitally applied ink need to provide wear resistance to a final digital image while the garment is worn, subjected to abrasive contact with other fabrics (such as while being cleaned in a washing machine), or comes in frictional or abrasive contact with floors, walls, carpet, etc. The pretreatment (noting it is a thin surface treatment rather than a thick coating) and digital ink image desirably neither significantly change the softness, flexibility, feel, etc., of the image area of the fabric or garment nor cause puckering of the fabric or garment due to different shrinkage rates in the image and non-image portion of the substrate. Most pretreatments (especially crosslinked pretreatments, which tend to be more durable) on textiles make the textile stiffer (less soft). Achieving similar softness to the uncoated textile on a coated textile while enhancing durability of an image on the coated textile is a difficult task.

Weight % means the number of parts by weight of ingredient per 100 parts by weight of composition or material of which the ingredient forms a part. In some of the examples we show weight percent of the active ingredient (usually the non-water ingredient/non-volatile) rather than the material as received from the manufacturer which can be 20-90 wt. % water.

In the pretreatment, one particularly preferred component is a surface active agent such as a surfactant. This is typically a nonionic surfactant, cationic surfactant, and/or poly(alkylene oxide) of greater than 200 g/mole molecular weight. These surfactants are typically used at concentrations from about 0 or 0.001 to about 1 wt. %, more desirably from about 0.02 to about 0.5 wt. % (measured as the active ingredient less water) of the pretreatment.

Blends with Other Polymers

The pretreatment of this invention can be combined with compatible polymers and polymer dispersions by methods well known to those skilled in the art. While polymers or polymer dispersions can be used, it is anticipated that the combination of the azetidinium functionalized polymer, copolymer of sulfur dioxide and allylamine and/or diallylamine and optional organic acid are sufficient to achieve all the necessary results for pretreatments for most cotton or polyester textiles. Such polymers, polymer solutions, and dispersions include those described in A. S. Teot. "Resins, Water-Soluble" in: Kirk-Othmer Encyclopedia of Chemical Technology, John Wiley & Sons. 3rd Ed., Vol. 20, H. F. Mark et al. Eds., pp. 207-230 (1982), the disclosures of which are incorporated herein by reference.

In one embodiment, the pretreatment solution of this invention typically has total solids (i.e., residues after oven drying at 105° C. for 1 hour) of at least about 2, 3, 4 or 5 wt. % based on the weight of the pretreatment. In one embodiment, the pretreatment solution will have total solids of less than 50, 40, 30, 20, 15, or 10 wt. % based on drying a one gram sample at 102° C. for 1 hour or until constant weight. In one embodiment, the non-volatile portion (as measured at 102° C. for 1 hour) of the pretreatment solution will desirably be about for 2 to about 5 or 10 wt. % of the solution. In one embodiment, the non-volatile portion will be less than 30, 20, or 15 wt. % of the pretreatment solution.

The dispersions of this invention can be formed by mixing the components in almost any order while trying to avoid excessive molecular weight buildup (crosslinking of the active component) until applied to a textile substrate.

Applications

The compositions of the present invention and their formulations are useful as pretreatments for textiles or garments to enhance digital image printing. Generally, but not as a restriction on the invention, we refer to the pretreatment on a textile or fabric as a coating, we mean that the pretreatment forms a partial and/or complete coating on the fibers or substrate and not necessarily an impervious film (impervious films are more likely to occur when coating smooth metal, plastic or wood). Pretreatments are often applied by spraying or padding. When the pretreatment is applied by padding, it may approach completely surrounding each fiber or group of fibers. The pretreatment may not completely cover each and every fiber when applied by spraying (especially fibers deep in the textile or cloth or in situations where fibers cross each other). The uniform application of pretreatment by padding or spraying is important to industrial digital printing of the fabric in a roll to roll format. Generally, on textiles and cloth, it is desired that the substrate after pretreatment is as porous to water or air as the untreated substrate (which requires the coated textile to have lots of pores after pretreatment).

In most commercial uses of fabric or garment pretreatments, the pretreatment would be applied to full-sized T-shirts with a pretreatment machine such as a Viper Gen 1 or Gen 2 machine. In the laboratory we used a Wagner® Power Sprayer model #0417201, which works similarly to a Viper™ Gen 1 or Gen 2. In this type of commercial pretreatment equipment the pretreatment solution is applied through an array of nozzles covering the width of the T-shirt. The T-shirt fabric generally is mounted on a stage. The stage moves past the nozzle array to expose the fabric to the pretreatment.

Preferred substrates for the pretreatment of this disclosure are garments or textiles for which some image (preferably digitally applied) is desired for labeling, decoration, advertising, etc. Preferred substrates are shirts with t-shirts and sport shirts being a suitable use. Substrates also include synthetic polymer films, such as might be used for banners, posters, advertising, etc., and may be films, woven, or non-woven. In one embodiment, the polymer substrate or film is a polyolefin, such as polypropylene, or polyester. When the substrate is a polymer film it may be desirable to have moderate to high loadings of inorganic filler in the polymer film. In one embodiment, woven or non-woven substrates are at least 25, 50 or 80 wt. % cotton, based on the weight of the fabric or substrate. In another embodiment, woven or non-woven substrates desirably have at least 25, 50, or 80 wt. % polyester based on the weight of the fabric or substrate. In some applications, the substrate can be fiberglass and/or paper.

EXAMPLES

In these examples, the following reagents were used

Polycup™ 172 is a polyamide-epichlorohydrin azetidinium functionalized polymer available from Ashland-Hercules Water Technologies.

Polycup™ 7360 is a polyamine-epichlorohydrin azetidinium functionalized polymer available from Ashland-Hercules Water Technologies.

Danfix™ 303 is a copolymer of a quaternary ammonium salt of N,N-dimethyldiallylammonium chloride and sulfur dioxide of about 4000 or 5000 g/mole molecular weight available from Nittobo BYK®-347—surfactant available from Byk Chemie in Europe IPA—isopropyl alcohol DPG is dipropylene glycol Acticide™ MV is 10.6 wt. % 5-chloro-2-methyl-4-isothizolin-3-one and 3.5 wt. % 2-methyl-4-isothiazolin-3-one available from Thor GmbH in Trumbell, Conn., USA.

Examples for Cationic Polyurethanes

Example A

Pretreatment

TABLE 1

Pretreatment Compositions

| Ingredient | Pretreatment A | Pretreatment B |
|---|---|---|
| Polycup ™ 7360 or 172 | 1.55 parts by weight | 1.55 |
| Danfix ® 303 | 1.55 | 1.55 |
| Itaconic acid | 0.00 | 1.55 |
| Dipropylene glycol | 0.08 | 0.08 |
| Isopropyl alcohol | 0.81 | 0.81 |
| Byk ™ 347 | 0.01 | 0.01 |
| Acticide MV | 0.0004 | 0.0004 |
| Water | residual | residual |

All parts by weight are based on the active ingredient and exclude water that may have been in the commercial product.

Recipes for Pretreatment Compositions Using Cationic Polymer and Azetidiniumpolyurethanes and Control Pretreatments Procedure for Making Pre-Treatments Padding Method for Applying Pretreatment The pretreatment was applied to fabric pieces for most of the examples with a spray application, a padding method is also commonly used in the textile industry. The pretreatment solution was allowed to soak into the fabric for about 3 minutes or until the fabric was completely saturated. The fabric was then passed through a nip (at 30-40 psi) formed by a rubber covered bottom roll and a steel top roll of a two roll wringer to remove the excess pretreatment from the fabric. The sample was then dried and cured in a heated garment press (Insta™ Model #715 Cerritos, Calif.). Curing instructions are shown in Table 2.

TABLE 2

Fabric Pretreatment and Ink, Temperature, Duration and Pressure

| Fabric/Textile Substrate | Temp ° C. | Duration: Pretreatment | Duration: Colored Ink | Pressure |
|---|---|---|---|---|
| Polyester | 140 | 1 min | 3 min | 40 psi |
| Polyester/Cotton blend (PES/COT) | 140 | 1 min | 3 min | 40 psi |
| Cotton | 160 | 1 min | 3 min | 40 psi |

All pressures in this specification are gauge pressures. Gauge pressures mean pressure above 15 psi of atmospheric pressure at sea level.
Pre-treat may not completely dry when time is too short The pretreatment add-on was determined by weighing the fabric immediately before and after the pretreatment application and the results are expressed by wet g/in$^2$ of fabric, or by conditioning the fabric in a constant temperature/constant humidity room (21° C.(70° F.)/50% RH) overnight to get dry g/in$^2$. The add-on percentage (usually in dry g) can then be calculated. In general, the pretreatment add-on was 30-35% on polyester, 20-25% on a polyester/cotton blend and 15-20% on cotton.

Spraying Method for Applying Pretreatment

If an example indicates pretreatment by spraying, the pretreatment was applied to full-sized T-shirts by spraying. A conventional-style pneumatically-powered air-spray gun from BINKS (model #2001; www.binks.com) may be used. See Table 3 for application guidelines. The curing conditions (irrespective of how the pretreatment was applied) are shown in Table 2 above.

TABLE 3

Pretreatment application details

| Fabric | Wet pretreatment (g) | Area (in)$^2$ | Wet pretreatment (g/in$^2$) |
|---|---|---|---|
| Polyester | 34.4 | 344 | 0.08 |
| Cotton | 10.3 | 344 | 0.03 |
| Polyester/Cotton Blend | 24.1 | 344 | 0.07 |

Pigmented Ink Application

When the white or colored digital ink was applied digitally, the DTG white and colored inks were printed using a DTG printer (DTG Digital Viper by Colman and Company). The white and colored inks used in the disclosure (whether applied manually or digitally) can be purchased over the internet from companies such as DuPont under its Artistri™ trade name, M&R Companies in Glen Ellyn, Ill., and marketers such as Belquette, Inc. in Clearwater, Fla., Atlas Screen Supply Co. in Illinois, and Garment Printer Ink in New York, N.Y.

Washing Test

A GE Profile™ home laundry top loading washer (model # WPRE8100G) was used for the home laundering wash test. The settings were: hot wash and cold rinse, extra-large load and casual heavy wash. The fabric samples were put into the washer together with 5 standard-sized lab coats. A standard washing cycle (45 minutes at 132° F.) was used to wash the fabric for 5 consecutive complete wash cycles. The detergent used was Tide Liquid detergent at the recommended dosage per load. The five home launderings (i.e., the wet garments were rewashed four additional times) were followed by one single tumble dry cycle (on auto cycle permanent press) using an American Motors Corp (Model # DE-840B-53) dryer.

Chromaticity Diagram for Ink Retention and Color Value

The fabrics (cotton and polyester) after pretreatment A (inventive) or DTG pretreatment (control) were printed with colored inks and cured following the same instructions from Table 2. The x and y values were measured on the area with colored inks using a colorimetric meter made by Gretag-Macbeth (Model # Color i 7). The fabric was then subjected to 5 home launderings and one dry cycle as described above.

Loss of ink color (loss of chromaticity) by washing is measured by units of x and y after the 5 launderings and one dry cycle.

The printed image was cured at 140-160° C. for 1-2 minutes. The only difference between samples was the use of inventive Pretreatment A versus the commercial pretreatment DTG (control) available from DuPont.

Figure 2:
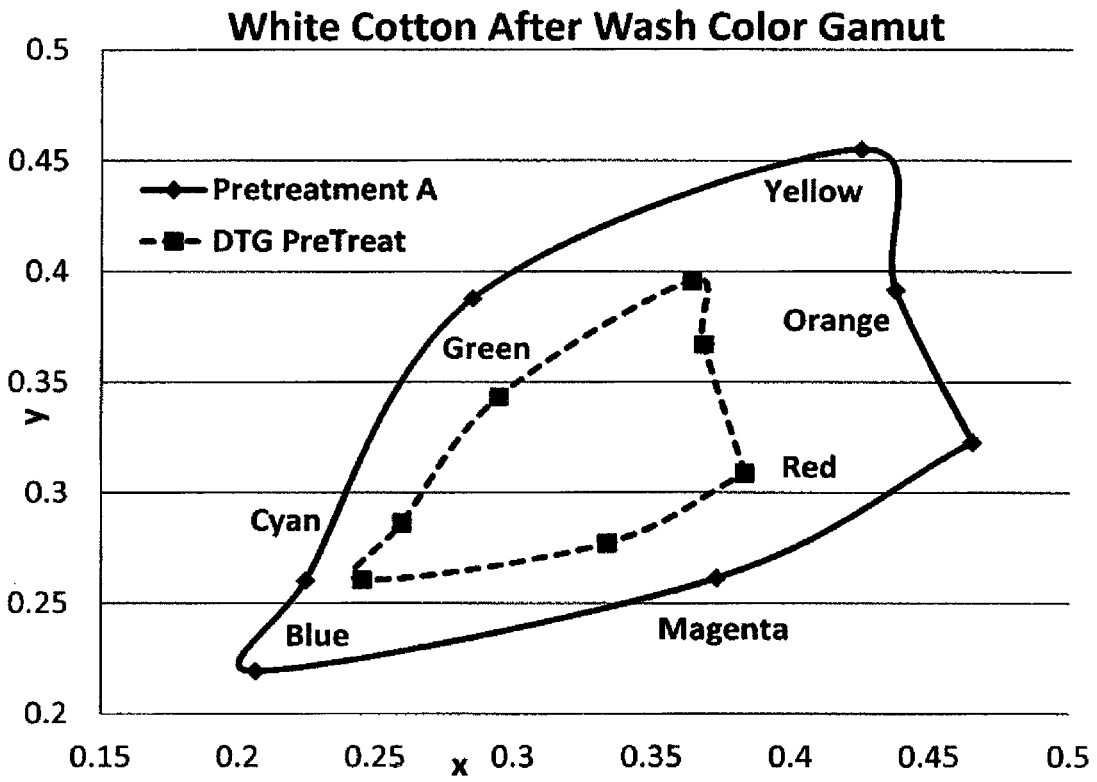

The FIGS. 1 and 2 shows the difference between color results on the Pretreatment A pretreatment and the commercial DTG treatment after a variety of standard commercially available color inks were digitally applied to fabrics treated with Pretreatment A or a commercial digital print pretreatment (available from DuPont as DTG) in a Chromaticity Diagram. Generally, the larger the area within the color diagram the higher the color intensity. The x and y coordinates can be measured directly with a GretagMacbeth colorimetric meter according to ASTM E308-85 (which also supplies L*a*b* measurements).

While certain representative embodiments and details have been shown for the purpose of illustrating the subject invention, it will be apparent to those skilled in this art that various changes and modifications can be made therein without departing from the scope of the subject invention.

What is claimed is:

1. A substrate pretreatment material comprising;

a) from 0.1 to 50 weight percent of an azetidinium functionalized polymer, b) from about 0.1 to 50 weight percent of an at least partially quaternized copolymer of sulfur dioxide and allylamine and/or diallylamine of weight average molecular weight from about 3,000 to 200,000 g/mole, wherein allylamine includes mono, di, and trialkyl ($C_1$-$C_6$) substituted allylamine and diallylamine includes mono and dialkyl ($C_1$-$C_6$) substituted diallylamine, c) optionally a surface tension modifier selected from the group of mono or polyhydroxy $C_1$-$C_{10}$ alcohol, an alkylene oxide oligomer of less than 500 g/mole molecular weight, or a surfactant, wherein said weight percent are based on 100 parts by weight of substrate pretreatment.

2. The substrate pretreatment material of claim 1, wherein said azetidinium functionalized polymer has on average at least five azetidinium groups per polymer and of number average molecular weight from about 5,000 to 500,000 g/mole and wherein said copolymer has at least 5 quaternized amine groups per polymer.

3. The substrate pretreatment material of any of claim 1, further comprising a 0.2 to 15 weight percent of an organic acid.

4. The substrate pretreatment material of claim 1, wherein said surface tension modifier is present and comprises both a $C_1$-$C_{10}$ alcohol and an alkylene oxide oligomer of less than 500 g/mole molecular weight.

5. The substrate pretreatment material of claim 1 further comprising a surface active agent.

6. The substrate pretreatment material of claim 1, wherein the polymer with pendant azetidinium groups is present from about 0.2 to about 10% by weight based upon the weight of said substrate pretreatment as applied.

7. The substrate pretreatment material of claim 1, wherein said copolymer of sulfur dioxide and allylamine and/or diallylamine is present from about 0.2 to about 10% by weight based upon the weight of said substrate pretreatment as applied.

8. The substrate pretreatment material of claim 1, wherein the polymer with pendant azetidinium groups is present from about 1 to about 5% by weight based upon the weight of said substrate pretreatment as applied.

9. The substrate pretreatment material of claim 1, wherein said copolymer of sulfur dioxide and allylamine and/or diallylamine is present from about 1 to about 5% by weight based upon the weight of said substrate pretreatment as applied.

10. A substrate pretreatment material, according to claim 1, as a dried film, surface treatment, or coating on a substrate, said substrate comprising a polymer film or a woven or non-woven substrate.

11. The substrate pretreatment material, as a dried film, surface treatment, or coating, on a substrate according to claim 10 in the form of a textile cloth or garment.

12. The substrate pretreatment on a substrate according to claim 10, wherein said woven or non-woven substrate is at least 25 wt. % cotton, more desirably at least 50 wt. % cotton, and preferably at least 80 wt. % cotton.

13. The substrate pretreatment on a substrate according to claim 10, wherein said woven or non-woven substrate is at least 25 wt. % polyester, more desirable at least 50 wt. % polyester and in one embodiment preferably at least 80 wt. % polyester.

14. The substrate pretreatment coating on a substrate according to claim 10, further comprising a printed image on the pretreatment coating (more desirably wherein the printed image includes at least one pigment).

15. The substrate pretreatment on a substrate according to claim 10, optionally including a polymeric binder, wherein the substrate is a polymeric film.

16. A process for pretreating a textile substrate and printing thereon with a pigment containing digitally applied ink comprising, a) providing a textile substrate, b) applying a substrate pretreatment according to claim 1, c) digitally printing with a pigment containing ink on the substrate pretreatment.

17. The process for pretreating a textile substrate and printing thereon with a pigment containing digitally applied ink according to claim 16, further comprising a drying step between applying the pretreatment and digitally printing with a pigment containing ink on the substrate pretreatment.

18. The process for pretreating a textile substrate and printing thereon with a pigment containing digitally applied ink according to claim 16, further comprising a step of heating the substrate, pretreatment and optionally one or more pigment containing inks to effect bonding to the substrate at a temperature from about 100° C. to about 160° C. for at least one minute.

19. The process according to claim 16, wherein said textile substrate comprises at least 25 wt. % polyester fibers based on the weight of said textile.

20. The process according to claim 16, wherein said textile substrate comprises at least 25 wt. % cotton fibers based on the weight of said textile.

* * * * *